US010433407B2

(12) United States Patent
Ihara

(10) Patent No.: US 10,433,407 B2
(45) Date of Patent: Oct. 1, 2019

(54) ILLUMINATION SYSTEM, OPERATION TERMINAL, AND SETTING METHOD OF ILLUMINATION EQUIPMENT IN ILLUMINATION SYSTEM

(71) Applicant: Panasonic Intellectual Property Management Co., Ltd., Osaka (JP)

(72) Inventor: Kosuke Ihara, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/014,814

(22) Filed: Jun. 21, 2018

(65) Prior Publication Data

US 2018/0376563 A1 Dec. 27, 2018

(30) Foreign Application Priority Data

Jun. 23, 2017 (JP) ..... 2017-123123

(51) Int. Cl.
*F21V 33/00* (2006.01)
*H05B 37/02* (2006.01)
*F21V 23/00* (2015.01)

(52) U.S. Cl.
CPC ..... *H05B 37/029* (2013.01); *F21V 23/003* (2013.01); *H05B 37/0254* (2013.01)

(58) Field of Classification Search
CPC ..... F21V 33/00; F21V 23/003; H05B 37/029; H05B 37/0254
USPC ..... 362/88
See application file for complete search history.

(56) References Cited

U.S. PATENT DOCUMENTS 7,550,931 B2 * 6/2009 Lys ..... A01M 1/04 315/291
2004/0032226 A1 * 2/2004 Lys ..... H04L 29/12254 315/294
2004/0036006 A1 * 2/2004 Dowling ..... B63G 13/02 250/205
2004/0052076 A1 * 3/2004 Mueller ..... F21V 23/0442 362/293
2010/0262296 A1 * 10/2010 Davis ..... G05B 15/02 700/275

(Continued)

FOREIGN PATENT DOCUMENTS

JP 2016-152171 A 8/2016

*Primary Examiner* — Ali Alavi
(74) *Attorney, Agent, or Firm* — McDermott Will & Emery LLP

(57) ABSTRACT

An illumination system includes an alert unit connected to a control device. During work to connect the illumination equipment to the relay, the control device searches whether or not the illumination equipment is connected, through the relay; when the connection of the illumination equipment is detected, sends an inquiry on a type of the illumination equipment to the illumination equipment and acquires information on the type of the illumination equipment; when the information on the type of the illumination equipment is the same as the planned connection equipment type stored in advance, sets an identification number for the illumination equipment connected to the control device; and, when the information on the type of the illumination equipment differs from the planned connection equipment type stored in advance, causes the alert unit to generate a first alert.

13 Claims, 9 Drawing Sheets

(56) References Cited

U.S. PATENT DOCUMENTS

2011/0204827 A1* 8/2011 Ishihara ..... H05B 37/029
315/313
2014/0132181 A1* 5/2014 Gerszberg ..... H05B 33/0857
315/292

* cited by examiner

ILLUMINATION SYSTEM, OPERATION TERMINAL, AND SETTING METHOD OF ILLUMINATION EQUIPMENT IN ILLUMINATION SYSTEM

CROSS REFERENCE TO RELATED APPLICATION

The entire disclosure of Japanese Patent Application No. 2017-123123 filed on Jun. 23, 2017, including the specification, claims, drawings, and abstract, is incorporated herein by reference in its entirety.

TECHNICAL FIELD

The present disclosure relates to an illumination system, an operation terminal, and a setting method of an illumination equipment in an illumination system.

BACKGROUND

In the related art, in studios of a television station, halls, or stages or the like, illumination effects are realized by attaching a plurality of illumination equipments on an elongated device called a baton which is suspended from the ceiling.

Japanese Unexamined Patent Application Publication No. 2016-152171 discloses an illumination control system in which the baton device detects all illumination equipments connected to the illumination control system, and an illumination control device collectively and automatically sets control addresses for the illumination equipments for which connection to the illumination control device is detected. The control address is an address for the illumination control system to control each illumination equipment.

In an illumination system in which a plurality of illumination equipments are connected to a control device via a relay, in cases where changing of the hanging of the illumination equipments occurs frequently, a problem has arisen where a long period of time is required for the hanging work of the illumination equipments, which is preparation work on that day. For example, in a studio, changing of the hanging of the illumination equipments occurs for every television program. In order to solve the above-described problem, an illumination system, a setting method of illumination equipment in the illumination system, and an operation terminal are desired which enable quick execution of setting of identification numbers to the illumination equipments during a hanging operation of the illumination equipments in an environment in which a large number of illumination equipments can be placed in the illumination system.

SUMMARY

According to one aspect of the present disclosure, there is provided an illumination system in which a plurality of illumination equipments are connected to a control device via a relay, the illumination system including: an alert unit connected to the control device, wherein the control device stores in advance information on the relay and a planned connection equipment type which is a type of an illumination equipment planned to be connected to the relay, and, during work to connect the illumination equipment to the relay, the control device: searches whether or not the illumination equipment is connected, through the relay; when the control device detects that the illumination equipment is connected based on a transmission signal from the illumination equipment, sends an inquiry on a type of the illumination equipment to the illumination equipment and acquires information on the type of the illumination equipment; when the information on the type of the illumination equipment is the same as the planned connection equipment type stored in advance, sets an identification number for the illumination equipment connected to the control device; and, when the information on the type of the illumination equipment differs from the planned connection equipment type stored in advance, causes the alert unit to generate a first alert.

According to another aspect of the present disclosure, there is provided an operation terminal used for forming the illumination system of the present disclosure, including the control device and the alert unit. According to another aspect of the present disclosure, there is provided a method of setting illumination equipment in an illumination system in which a plurality of illumination equipments are connected to a control device via a relay, wherein the control device stores in advance information on the relay and a planned connection equipment type which is a type of the illumination equipment planned to be connected to the relay, and the method includes: during work to connect the illumination equipment to the relay, searching, with the control device, whether or not the illumination equipment is connected, through the relay; when the control device detects that the illumination equipment is connected based on a transmission signal from the illumination equipment, sending, with the control device, an inquiry on a type of the illumination equipment to the illumination equipment and acquiring information on the type of the illumination equipment; when the information on the type of the illumination equipment is the same as the planned connection equipment type stored in advance, setting, with the control device, an identification number for the illumination equipment connected to the control device; and when the information on the type of the illumination equipment differs from the planned connection equipment type stored in advance, causing, with the control device, an alert unit connected to the control device to generate a first alert.

According to the illumination system, the operation terminal, and the setting method of the illumination equipment in the illumination system according to the present disclosure, setting of the identification number for the illumination equipment can be quickly executed during hanging work of the illumination equipment in an environment in which a large number of illumination equipments can be placed.

BRIEF DESCRIPTION OF DRAWINGS

The figures depict one or more implementations in accordance with the present teaching, by way of example only, not by way of limitations. In the figures, like reference numerals refer to the same or similar elements.

DESCRIPTION OF EMBODIMENTS

Figure 1:
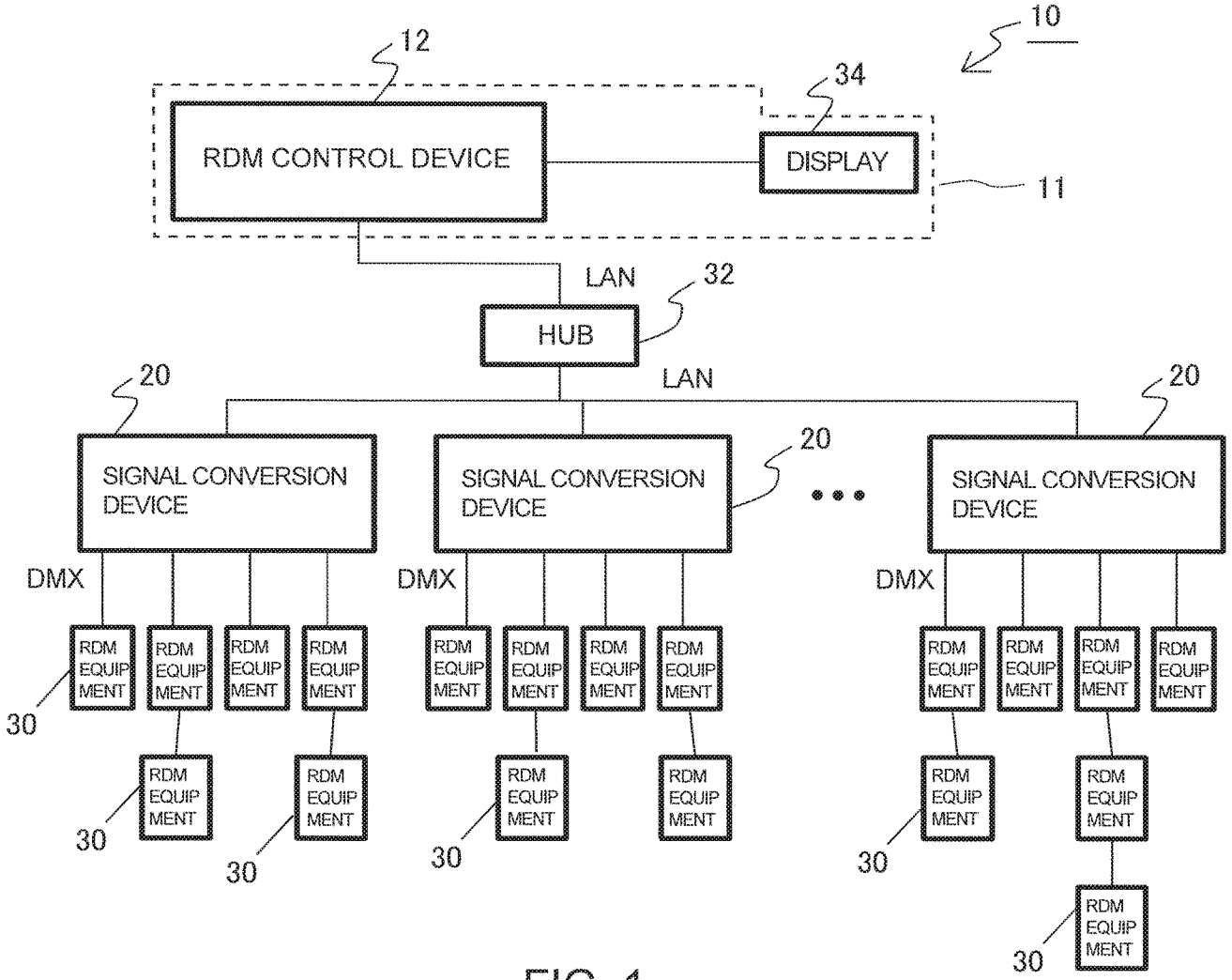
FIG. 1 is a block diagram showing an example structure of an illumination system according to an embodiment of the present disclosure.

An embodiment of the present disclosure will now be described in detail with reference to the drawings. In the following description, specific numerical values, amounts, directions, or the like are exemplary for the purpose of facilitating understanding of the present disclosure, and may be suitably changed according to specification of an illumination system to which a setting method of an illumination equipment is applied. Further, in the following description, when a plurality of embodiments and alternative configurations are included, suitable combination and use of the characteristic features thereof are conceived of from the beginning. In the following, similar elements in the drawings are assigned the same reference numerals for the description.

Figure 2:
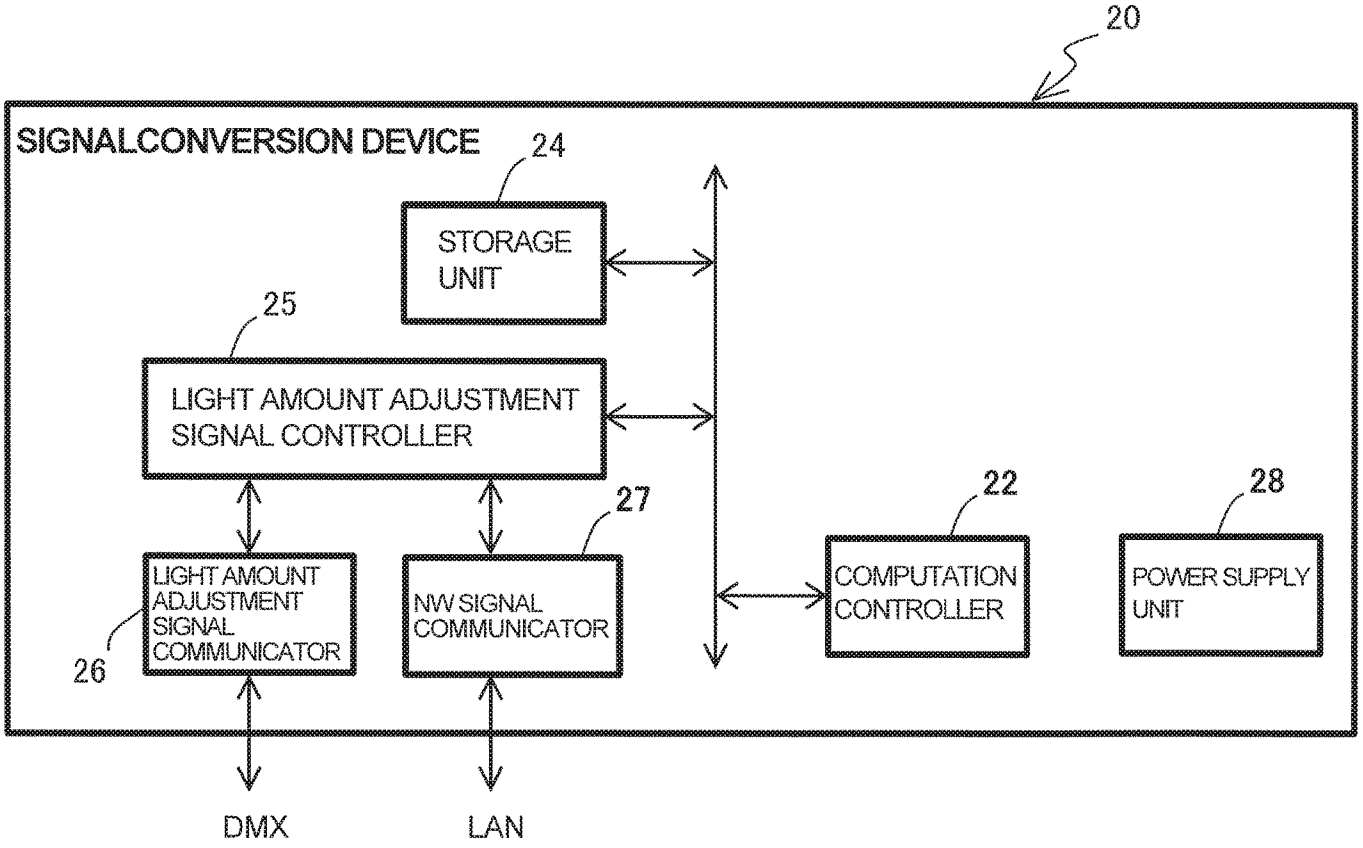
FIG. 2 is a block diagram showing a structure of a signal conversion device which is a relay in the illumination system shown in FIG. 1.

FIG. 1 is a block diagram showing an example structure of an illumination system 10 according to an embodiment of the present disclosure. FIG. 2 is a block diagram showing a structure of a signal conversion device 20 which is a relay in the illumination system 10.

In the illumination system 10, a plurality of illumination equipments (RDM compatible equipment) 30 are connected to an RDM control device 12, which is a control device, via a signal conversion device 20. Specifically, the illumination system 10 comprises the plurality of the illumination equipments 30, a plurality of the signal conversion devices 20, a hub 32, the RDM control device 12, and a display 34 which serves as an alert unit. In the following description, the RDM control device 12 may also be referred to as the control device 12. The number and types of the illumination equipments 30 and the signal conversion devices 20 in the illumination system 10 can be arbitrarily set.

The illumination equipment 30 is capable of bidirectional communication with the signal conversion device 20 and the control device 12 by a communication protocol according to an RDM (Remote Device Management) standard which is an expansion of the DMX 512-A standard, and is attached to a baton device (not shown). The illumination equipment 30 includes a semiconductor light emitting element such as an LED, and an ON-OFF state and light amount adjustment or the like are controlled according to a control signal. In this manner, illumination effects can be realized in the environment in which a large number of illumination equipments 30 can be placed such as a studio, a hall, or the like. The illumination equipment 30 has an input terminal and an output terminal, and input terminals and output terminals of two illumination equipments 30 can be connected to connect two illumination equipments 30. To each illumination equipment 30, electric power is supplied from a power supply device (not shown) through the baton device.

The signal conversion device 20 is connected to the plurality of illumination equipments 30 and the hub 32. The signal conversion device 20 is a device which converts a signal transmitted according to the Ethernet (registered trademark) standard using a LAN cable into a signal transmitted according to the RDM standard using a plurality of DMX cables. For this purpose, the signal conversion device 20 comprises a port to which the LAN cable can be connected, and a plurality of ports to which the DMX cables can be connected. The signal conversion device 20 is provided at each of the plurality of baton devices. Because of this, in each baton device, a plurality of illumination equipments 30 connected to the corresponding signal conversion device 20 are hung.

As shown in FIG. 2, the signal conversion device 20 comprises a computation controller 22, a storage unit 24, a light amount adjustment signal controller 25, a light amount adjustment signal communicator 26, a network signal communicator 27, and a power supply unit 28. To the light amount adjustment signal controller 25, the DMX cable is connected through the light amount adjustment signal communicator 26, and the LAN cable is connected through the network signal communicator 27.

The light amount adjustment signal controller 25 converts the signal transmitted by the LAN cable into the signal transmitted by the DMX cable. The power supply unit 28 supplies electric power to the constituting elements of the signal conversion device 20 including the computation controller 22, the light amount adjustment signal controller 25, or the like.

Referring back to FIG. 1, when the plurality of illumination equipments are hung, the illumination equipment 30 is attached to the corresponding baton device, and the port of the signal conversion device 20 and the port of the illumination equipment 30 are connected to each other by the DMX cable.

The hub 32 is a relay, and is connected to the control device 12 through the LAN cable and to the signal conversion device 20 through the LAN cable. With this structure, the hub 32 relays the communication between the control device 12 and the signal conversion device 20.

The control device 12 is desirably formed by a microcomputer comprising a computation processor, a storage unit such as a memory, and an I/O interface, or the like. The control device 12 executes a predetermined operation by reading programs, data, or the like stored in the storage unit. By the control device 12 executing the programs, the device, the system, or the functions of the subject of the method of the present disclosure are realized. The control device 12 comprises a processor (computation processor) which operates according to a program, as a primary hardware structure. The processor may be of any type so long as the functions can be realized by executing a program. The processor is formed from one or a plurality of electronic circuits including a semiconductor integrated circuit (IC), or an LSI (Large Scale Integration). The plurality of electronic circuits may be integrated on one chip or provided over a plurality of chips. The plurality of chips may be put together into one device or provided over a plurality of devices. The storage unit is a ROM or the like which can be read by the computation processor. As the storage unit, a non-transitory storage medium such as an optical disk, a hard disk drive, or the like may be used. The program may be stored in the recording medium in advance, or supplied to the recording medium through a wide area communication network including the Internet.

An operation unit (not shown) is connected to the control device 12. The control device 12 controls the ON-OFF state, light amount adjustment, or the like, of the illumination equipment 30 through the hub 32 and the signal conversion device 20, in response to an operation of the operation unit by a user.

In addition, the control device 12 sets (assigns) a DMX number which is an identification number and also a control address, to an illumination equipment 30 connected to the signal conversion device 20 during hanging work of the illumination equipment 30, as will be described later. Using the DMX number, the ON-OFF state, the light amount adjustment, or the like of each illumination equipment 30 is controlled in response to the operation of the operation unit.

The display 34 is a display device, and is connected to the control device 12, and a screen display thereof is controlled by the control device 12. The display 34 has, for example, a touch panel, and also has a function as an input accepting unit which accepts an input by an operation of the touch panel on the screen by the user. The input which is accepted on the display 34 is sent to the control device 12 as a signal.

Figure 7:
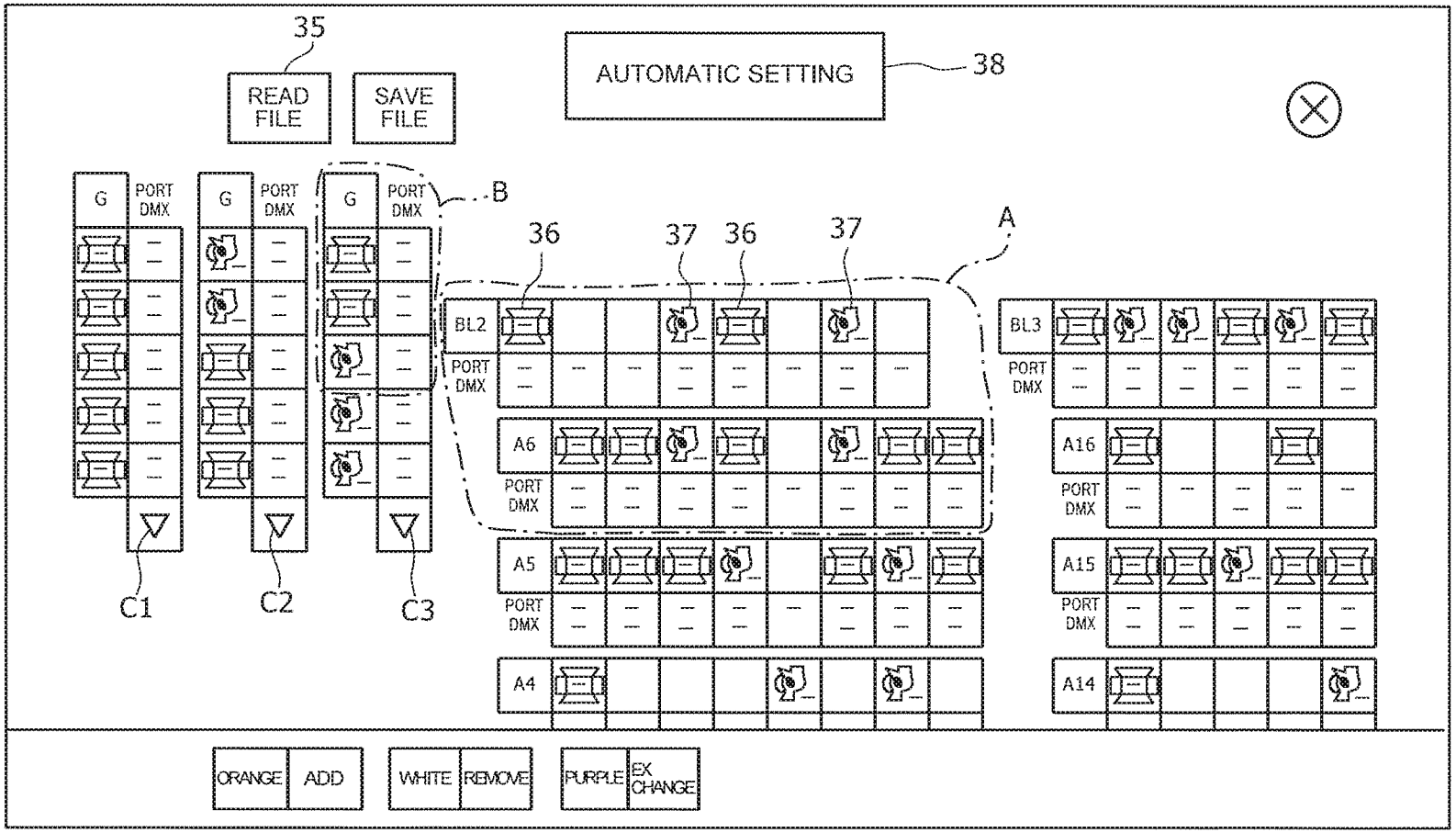
FIG. 7 is a diagram showing an example screen of a display which is an alert unit connected to the control device in the illumination system shown in FIG. 1.

For example, by a number setting program being executed during DMX number setting, the control device 12 causes the display 34 to display an image shown in FIG. 7, which will be described later. The number setting program is stored in the storage unit of the control device 12 in advance. In addition, on a screen on which the image as shown in FIG. 7 is displayed, the user may press an input accepting unit such as an automatic setting input accepting unit 38, to be described later, with their finger, so that a signal corresponding to the input is sent to the control device 12. Moreover, the display 34 also functions as an alert unit which generates a first alert by a display, as will be described later. Alternatively, as shown in FIG. 1 with a broken line, an operation terminal 11 may be formed including the control device 12 and the display 34. In this case, the operation terminal 11 is used for forming the illumination system 10. The operation terminal may include an operation unit connected to the control device 12.

The control device 12 stores in advance information on the signal conversion device 20 and a planned connection equipment types which are types of a plurality of illumination equipments 30 planned to be connected to the signal conversion device 20. Further, during work to connect the illumination equipments 30 to the signal conversion device 20, the control device 12 searches whether or not the illumination equipments 30 are connected, through the signal conversion device 20. During the search, when the control device 12 detects that the illumination equipment 30 is connected, based on a transmission signal from the illumination equipment 30, the control device 12 sends an inquiry to the illumination equipment 30 on a type of the illumination equipment 30. The control device 12 then acquires the information on the type of the illumination equipment 30, and when the information on the type of the illumination equipment 30 is the same as the planned connection equipment type stored in advance, the control device 12 sets a DMX number for the illumination equipment 30 connected to the control device 12. On the other hand, when the information on the type of the illumination equipment 30 differs from the planned connection equipment type stored in advance, the control device 12 generates a first alert on the display 34. For example, the control device 12 causes an exchange equipment found icon, to be described later, to be displayed as the first alert on the screen of the display 34, at a portion showing the corresponding port of the baton device.

Figure 3:
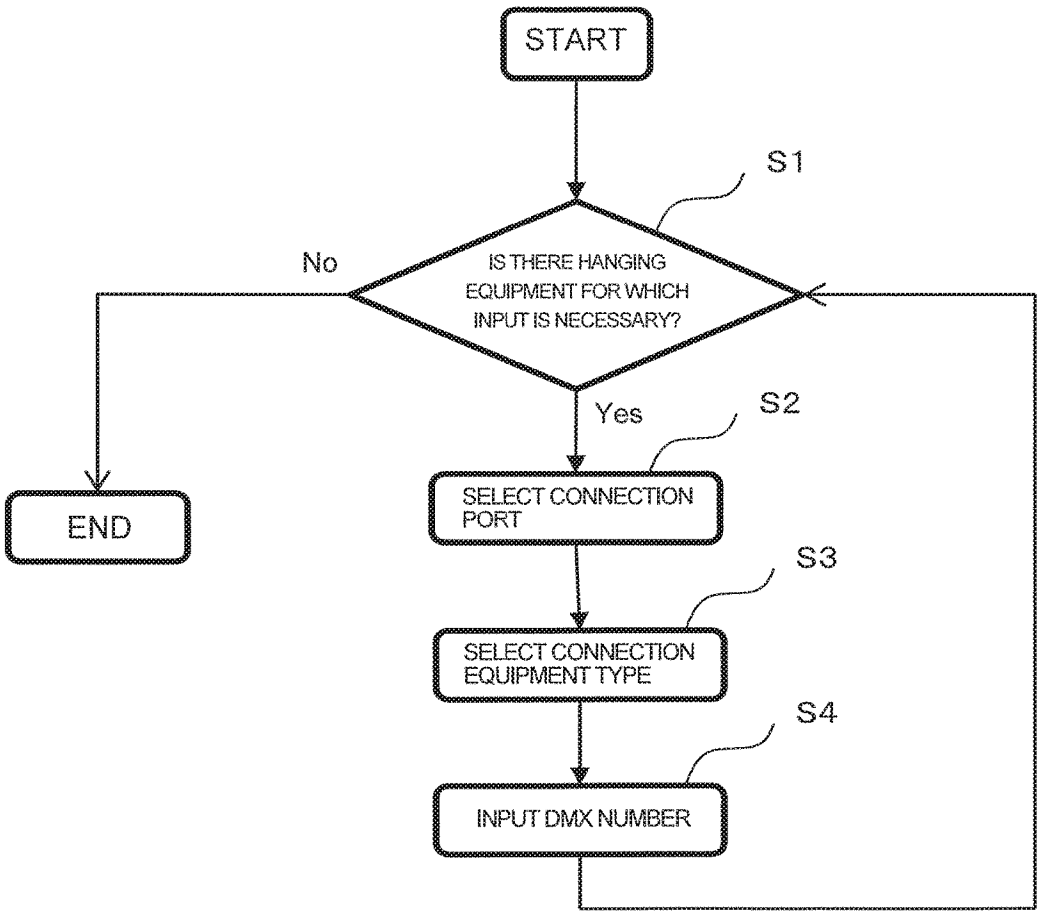
FIG. 3 is a flowchart showing judgment and work executed by a worker a day before hanging work of an illumination equipment.

Next, a number setting method of the illumination equipment 30 in the illumination system 10 will be described with reference to FIGS. 3~10. FIG. 3 is a flowchart showing judgement and work to be executed by a worker a day before the hanging work of the illumination equipment 30.

The worker who plans the hanging work prepares, the day before the hanging work, a management file establishing a hanging position of the illumination equipment 30, the connection port for the illumination equipment 30 on the signal conversion device 20, and the DMX number. In this process, for example, the worker creates the management file using a computer or the like of the company to which the worker belongs. First, in step S1 of FIG. 3, the worker judges whether or not there still exists hanging equipment which is the illumination equipment 30 for which input is necessary in the management file. When the judgment is negative in step S1 (No), as the management file is completed, the worker ends the input work. On the other hand, when the judgment is positive in step S1 (Yes), as the management file is incomplete, the process proceeds to step S2.

In step S2, a connection port for the illumination equipment 30 on the signal conversion device 20 is selected, and the type of the illumination equipment 30 to be connected to the connection port is selected (step S3). There may be cases where there are a plurality of types of illumination equipments 30. For example, the types of the illumination equipment 30 include a broad light, a spot light, a horizon light, or the like. In step S4, a DMX number to be set for the illumination equipment 30 to be connected to the connection port of the signal conversion device 20 is input. After step S4, the process returns to step S1, and the judgment and work are repeated. In this manner, the day before the hanging work, the connection port, the type, and the DMX number are set in the management file for all illumination equipments 30 for which the hanging work is to be executed on the day of the hanging work.

Figure 4:
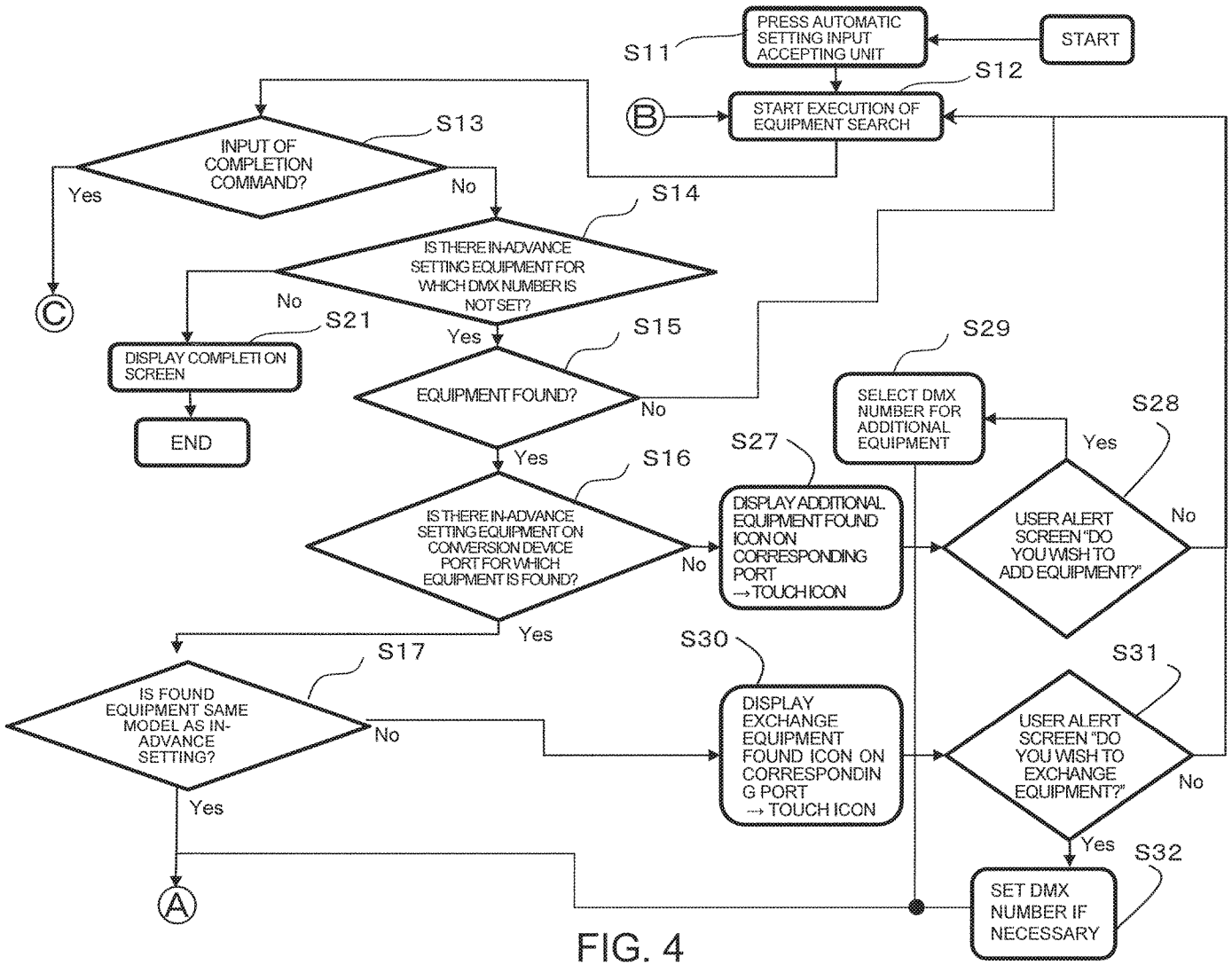
FIG. 4 is a diagram showing a first part of a flowchart showing a process executed by a control device on a day of the hanging work of the illumination equipment.
Figure 5:
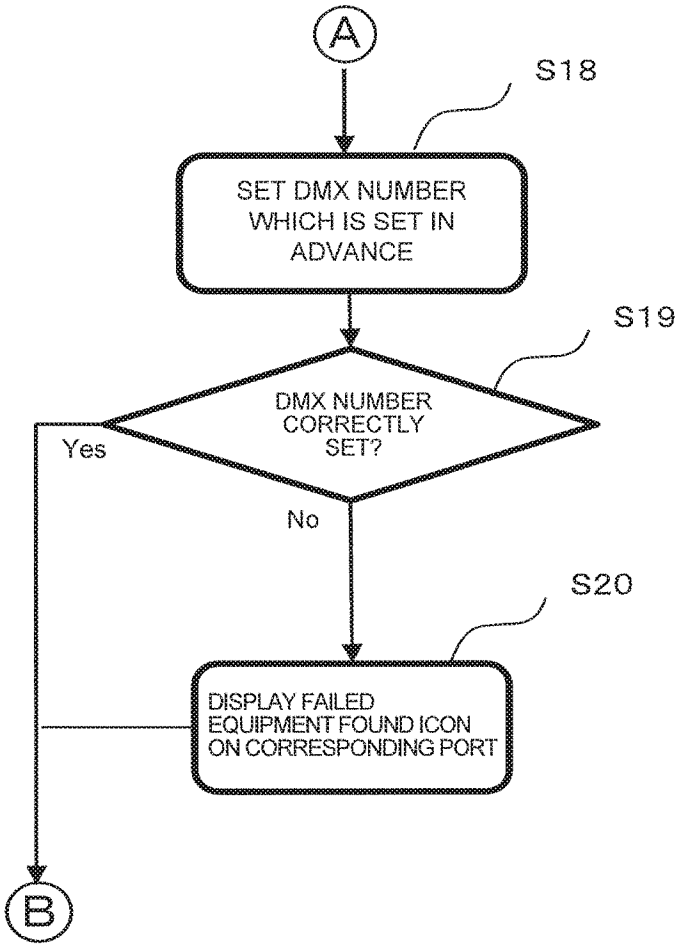
FIG. 5 is a diagram showing a second part of the flowchart showing the process executed by the control device on the day of the hanging work of the illumination equipment.
Figure 6:
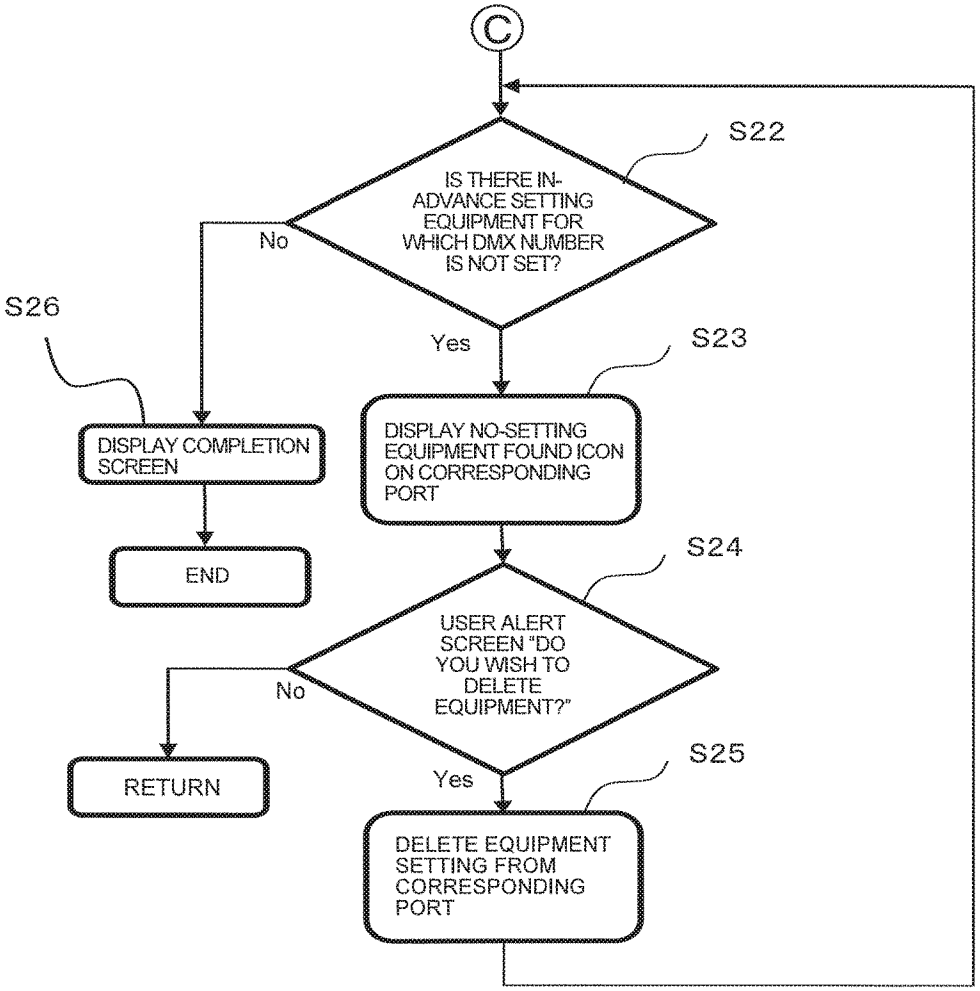
FIG. 6 is a diagram showing a third part of the flowchart showing the process executed by the control device on the day of the hanging work of the illumination equipment.

FIG. 4 is a diagram showing a first part of a flowchart showing a process executed by the control device 12 on the day of the hanging work of the illumination equipment 30. FIG. 5 is a diagram showing a second part of the flowchart showing the process executed by the control device 12 on the day of the hanging work of the illumination equipment 30. FIG. 6 is a diagram showing a third part of the flowchart showing the process executed by the control device 12 on the day of the hanging work of the illumination equipment 30.

Figure 8:
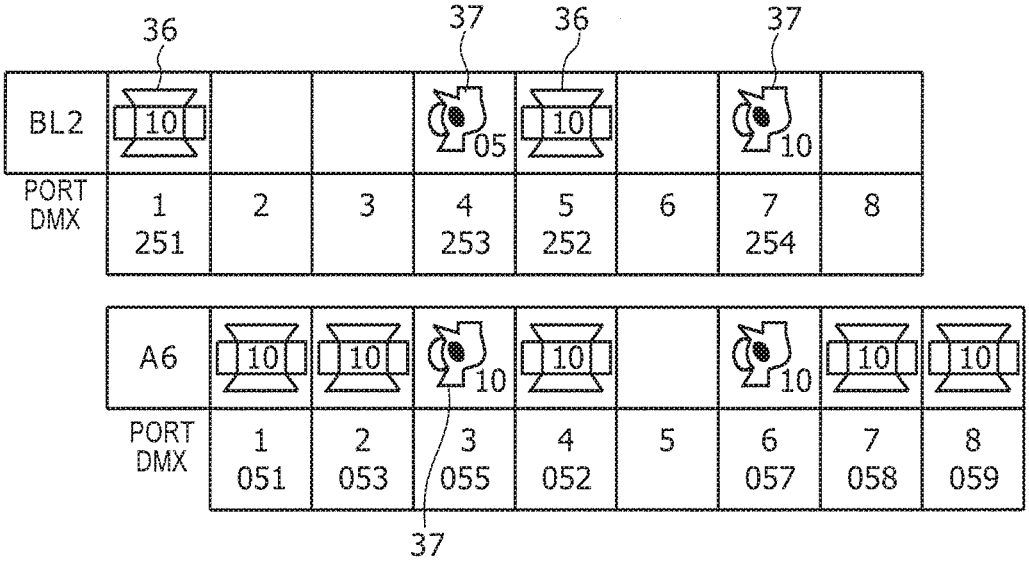
FIG. 8 is an enlarged view of an A part of FIG. 7.
Figure 9:
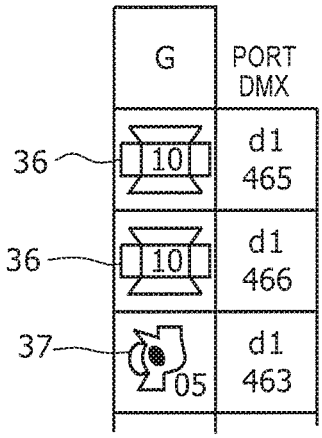
FIG. 9 is an enlarged view of a B part of FIG. 7.

On the day of the hanging work, for example, the user executes a number setting program of the control device 12 in the studio or the like, to display the image as shown in FIG. 7 on the display 34. FIG. 7 is a diagram showing an example screen of the display 34. FIG. 8 is an enlarged view of the A part of FIG. 7. FIG. 9 is an enlarged view of a B part of FIG. 7.

Next, the control device l2 reads the management file which is already created. In this process, the management file is read into the control device 12 via a file accepting unit (not shown). For example, the file accepting unit is a cable terminal, a disk drive device, or the like, of the control device 12. For example, in a state where a computer storing the management file is connected to the cable terminal of the control device 12 via a cable, the user such as the worker presses a file reading input accepting unit 35 (FIG. 7) on the screen of the display 34 with their finger. With this process, the management file is read from the computer storing the management file into the control device 12. Alternatively, the user may press the file reading input accepting unit 35 of the display 34 with their finger in a state where a compact disc (CD) which is a recording medium storing the management file is set in a disk drive device connected to the control device 12. With this process, the management file may be read from the computer storing the management file into the control device 12. With this reading, in the control device 12, information on the signal conversion device 20 and the planned connection equipment type, which is a type of the illumination equipment 30 planned to be connected to the signal conversion device 20, are stored in advance.

The image shown in FIG. 7 is displayed according to the input contents of the management file. On the screen on which the image is displayed, the input is also accepted. In FIG. 7, the placements of the baton devices are schematically shown by a group of frames of rows or columns in which G, BL2, BL3, A4~A6, and A14~A16 are shown. In addition, with icons 36 and 37 of two types of light shapes shown in a rectangular frame, two types of illumination equipments 30 planned to be connected to the ports of the signal conversion device 20 in the baton device are shown. The icon 36 shows a broad light and the icon 37 shows a spot light. In FIGS. 7~9, a part of the icons 36 and 37 is shown, for example, with a white background, and an outer side of the icons 36 and 37 is black in the rectangular frame showing the corresponding port. In addition, as shown in FIGS. 8 and 9, for at least some of the ports corresponding to the baton devices, setting of the illumination equipments 30 shown by the icons 36 and 37 is planned. The DMX numbers planned to be set to the illumination equipments 30 are respectively shown by 251~254, 051, 052, 053, 055, 057~059, 463, 465, and 466. FIG. 9 shows that the illumination equipments 30 shown by the plurality of icons 36 and 37 are connected to the same d1 port as a connected entity. When the user touches a portion in which a triangle is shown in the frame in FIG. 7 (portions of FIG. 7 shown by C1, C2, and C3), other illumination equipments 30 planned to be connected to the port are displayed. Further, when the user slides the screen shown in FIG. 7 upward using their finger, ports of a baton device at a lower side (not shown in FIG. 7) and the illumination equipment 30 planned to be connected to this port are displayed.

Referring again to FIG. 4, in step S11, when the user such as the worker presses the automatic setting input accepting unit 38 on the screen of FIG. 7 with their finger, an automatic setting mode is started. After the automatic setting mode is started, the worker starts the hanging work of the illumination equipment 30.

After the automatic setting mode is started, the control device 12 executes a sequential round search for the network environment in the studio, to detect the hanging of each illumination equipment 30 and to set in order the DMX number which is set in advance. When all of the illumination equipments 30 are hung according to the in-advance setting, the setting of the DMX number is completed approximately simultaneously with the last illumination equipment 30 being hung. In this manner, the time for hanging of the illumination equipment 30 can be significantly reduced. For example, a setting method of Comparative Example may be considered in which the worker manually sets the DMX number for the illumination equipment 30 after the hanging is executed for each illumination equipment 30. In such a setting method of the Comparative Example, a long period of time is required for setting the DMX number, and consequently, a long period of time is required for the hanging work. On the contrary, in the present embodiment, the DMX number setting for the illumination equipment 30 can be quickly executed during the hanging work of the illumination equipment 30, and thus, the above-described disadvantage of the Comparative Example may be resolved.

In addition, in the present embodiment, during the execution of the above-described automatic setting mode, if the type of the illumination equipment 30 differs from that registered in advance, an alert is given to the user at the time of detection. If it is the user's intent to exchange the illumination equipment, the user sets the number for the detected illumination equipment 30. On the other hand, when the user does not intend to exchange the illumination equipment 30, the user is urged by the alert to again hang a correct illumination equipment 30. Because the round search is again executed after the user's response to the alert, the DMX number setting for the illumination equipment 30 can be quickly executed during the hanging work of the illumination equipment 30, including the cases where a situation different from expected is caused during the hanging.

Specifically, after step S11 of FIG. 4, the following process is executed by the control device 12. In step S12, as an equipment search, for all ports of each signal conversion device 20, execution of the sequential round search of the illumination equipment 30 connected to the port is automatically started. With this process, for all ports of the signal conversion device 20, search of the illumination equipment 30 connected to the port is executed in order. After step S12, it is judged whether or not there is a completion command input by the user (step S13). A completion command input accepting unit is placed at a portion of the screen of FIG. 7, or on an operation unit (not shown). When the judgment result of step S13 is negative (No), in step S14, it is judged whether or not there exists an illumination equipment 30 planned to be set as an in-advance setting equipment for which no DMX number is set, for all ports of each signal conversion device 20.

When the judgment result in step S14 is negative (No), a completion screen indicating that the DMX numbers are set for all illumination equipments 30 is displayed on the display 34 (step S21), and the process is completed. In this manner, the search of the illumination equipment 30 is executed until the DMX numbers are correctly set for all illumination equipments 30 which are input by the management file in advance.

On the other hand, when the judgment result of step S14 is positive (Yes), in step S15, it is judged whether or not in-advance setting equipment for which the DMX number is not set is connected to a port of any signal conversion device 20, that is, whether or not an illumination equipment 30 is found. When the judgment result of step S15 is negative (No), the process returns to step S12, and the steps are repeated. In this manner, the search of the illumination equipment 30 is executed at the same time as the manual hanging of the illumination equipment 30 by the worker, and thus, the round search is executed even when no illumination equipment 30 is found.

On the other hand, when the judgment result in step S15 is positive (Yes), the process proceeds to step S16. In step S16, it is judged whether or not there is an illumination equipment 30 planned to be set as an in-advance setting equipment on a port of the signal conversion device 20 for which the illumination equipment 30 is found, that is, whether or not some illumination equipment 30 is planned to be connected to the port.

When the judgment result of step S16 is negative (No), the process proceeds to step S27, and an "additional equipment found icon" is shown in the corresponding port of the display 34 as a second alert. The display of the "additional equipment found icon" means that a new illumination equipment 30 is connected to a port for which no connection of the illumination equipment 30 is set.

Figure 10:
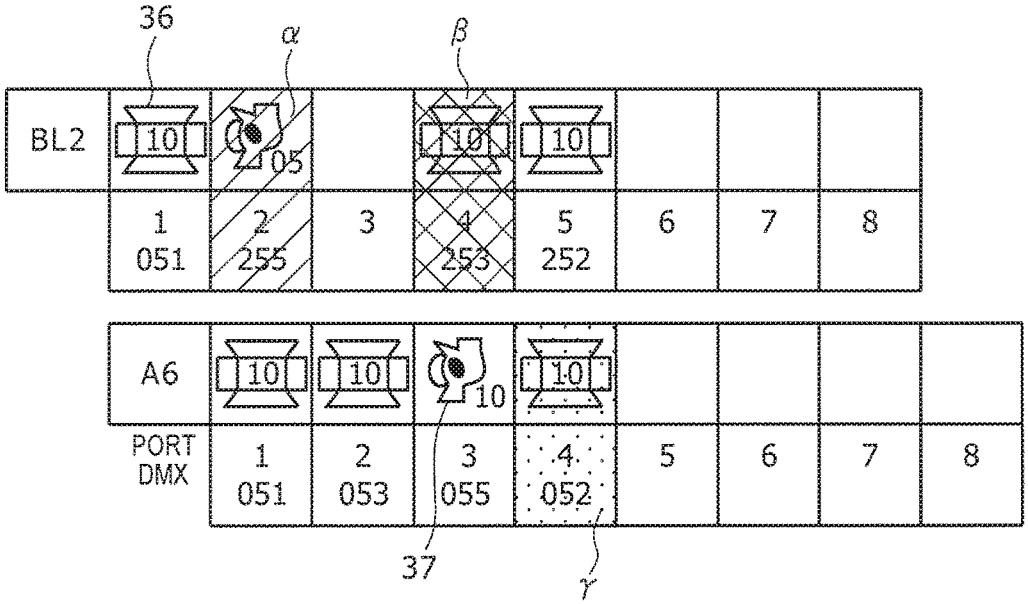
FIG. 10 is a diagram corresponding to FIG. 8, and showing a state where the alert is generated on the display.

FIG. 10 is a diagram corresponding to FIG. 8, and showing a state where the alert is generated on the display 34. As shown by a lower part of FIG. 7, an orange color means the addition of an equipment. A portion shown by a in FIG. 10 indicates that the additional equipment found icon is displayed on the corresponding port of the display 34, and the slanted line portion of the a portion indicates that the display is in the orange color. In this case, the "additional equipment found icon" is an icon of the same shape as and a different color from the icon 37, but alternatively, the additional equipment found icon may be an icon of a different shape from the icon 37.

With this process, the user can recognize that an illumination equipment 30 which did not exist in the in-advance setting is connected. In this case, if the user judges that the connection of the illumination equipment 30 is an error, the user removes the illumination equipment 30 from the corresponding port of the signal conversion device 20. When the removal of the illumination equipment 30 is detected, the "additional equipment found icon" is deleted, and the portion shown by the orange color is returned to the original color. On the other hand, when the user touches the "additional equipment found icon", in step S28 of FIG. 4, a dialog of "do you wish to add an equipment?" is displayed on the screen of the display 34 as a user alert screen. In this case, when the user intends to add the illumination equipment, the user selects "yes" in the dialog. That is, positive (Yes) is selected at step S28. In this case, the process proceeds to step S29. In step S29, the user manually inputs the DMX number of the illumination equipment which is the additional equipment using an operation unit such as a keyboard, to select the DMX number. Alternatively, in place of manually inputting the DMX number, the DMX number of the additional equipment may be automatically selected. After step S29 of FIG. 4, the process proceeds to step S18 of FIG. 5. In this process, a DMX number identical to that used in the in-advance setting cannot be selected. On the other hand, when the user selects "no" in the dialog; that is, when negative (No) is selected in step S28 of FIG. 4, the process returns to step S12. In this process, at the time when removal of the illumination equipment 30 from the corresponding port by the user is detected as described above, the "additional equipment found icon" disappears. In this manner, the control device 12 displays the additional equipment found icon when the control device 12 detects that the illumination equipment 30 is connected based on a transmission signal from the illumination equipment 30, and when the illumination equipment is not planned to be connected to a port on the side of the signal conversion device 20 for which the connection of the illumination equipment 30 is detected.

When the judgment result in step S16 of FIG. 4 is positive (Yes), the process proceeds to step S17. In step S17, the control device 12 sends an inquiry to the illumination equipment 30 for which the connection is found, in regard to the type of the illumination equipment 30, and acquires information on the type of the illumination equipment 30. It is then judged whether or not the information on the type of the illumination equipment 30 for which the connection is found is the same type, that is, the same model, as the planned connection equipment type of the illumination equipment 30 planned to be set as the in-advance setting equipment stored in advance. When the information on the type of the illumination equipment for which the connection is found is the same as the planned connection equipment type, the judgment result in step S17 is positive (Yes), and the process proceeds to step S18.

On the other hand, when the information on the type of the illumination equipment 30 for which the connection is found differs from the planned connection equipment type, the judgment result of step S17 is negative (No), and the process proceeds to step S30. In step S30, an "exchange equipment found icon" is displayed on the corresponding port of the display 34 as a first alert.

As shown at a lower part of FIG. 7, a purple color means equipment exchange. A portion shown by β in FIG. 10 indicates that the "exchange equipment found icon" is displayed on the corresponding port of the display 34, and a slanted lattice portion of the β portion indicates a purple color. In this case, the "exchange equipment found icon" is an icon of the same shape as and a different color from the icon 36, but alternatively, the icon may be an icon of a different shape from the icon 36.

With this process, the user can recognize that an illumination equipment 30 different from the in-advance setting is connected. In this process, if the user judges that the exchange of the illumination equipment 30 is an error, the user removes the illumination equipment 30 from the corresponding port, and attaches the illumination equipment 30 of the correct type, that is, hangs the illumination equipment again. When it is detected that the re-hung illumination equipment 30 is an illumination equipment 30 of the same type as the in-advance setting, the "exchange equipment found icon" disappears, and the portion shown by the purple color is returned to the original color. On the other hand, when the user touches the "exchange equipment found icon", in step S31 of FIG. 4, a dialog of "do you wish to exchange equipment?" is shown on the screen of the display 34 as a user alert screen. When the user intends to exchange the illumination equipment 30, the user selects "yes" in this dialog, that is, positive (Yes) is selected in step S31. In this case, the process proceeds to step S32. In step S32, the user inputs the DMX number of the illumination equipment 30 after the exchange by inputting the number using the operation unit such as the keyboard when necessary, and the number is set to the illumination equipment 30 after the exchange. After step S32, the process proceeds to step S18 of FIG. 5. In this case, in step S32, if there is no input from the user, the DMX number of the in-advance setting is set without any change, for the illumination equipment 30 after the exchange. On the other hand, when the user selects "no" in the dialog, that is, when negative (No) is selected in step S31, the process returns to step S12. In this case, when it is detected that the user has exchanged the illumination equipment connected to the port with the illumination equipment 30 of the correct type as described above, the "exchange equipment found icon" disappears.

In step S18 of FIG. 5, a signal showing the setting of the DMX number is transmitted from the control device 12 to the illumination equipment 30 connected to the corresponding port, and the DMX number is set for the illumination equipment 30.

Next, in step S19, it is judged whether or not the DMX number is correctly set for the corresponding port. When the judgment result of step S19 is positive (Yes), the process returns to step S12 of FIG. 4, and the steps are repeated.

On the other hand, when the judgment result of step S19 is negative (No), the process proceeds to step S20, and a "failed equipment found icon" (not shown) is displayed on the corresponding port of the display 34 as a fourth alert. In this case, the "failed equipment found icon" may be changed to a color different from the original color, such as blue, in the corresponding port of the display 34, in which case the user can easily recognize the icon. In this manner, the user can recognize that there is a possibility that a failed equipment is found for the corresponding port. When the user confirms that the connection between the corresponding port and the illumination equipment 30 by the DMX cable is correct, and that there is no problem in the connection, it means that the equipment is a failed equipment. Thus, the user exchanges the illumination equipment 30 with another illumination equipment 30. When the cable connection is erroneous and is correctly re-connected, or when the illumination equipment 30 is exchanged with non-failed equipment 30 and the DMX number is correctly set, the display of the failed equipment found icon disappears. When the judgment result of step S19 is positive (Yes), or after the process of step S20, the process returns to step S12 of FIG. 4.

On the other hand, when the judgment result is positive in step S13 of FIG. 4 (Yes), that is, when there is an input of a completion command by the user, the process proceeds to step S22 of FIG. 6. In this case, completion of the setting of the DMX number for the illumination equipment 30 is instructed by the user's intent. In step S22, similar to step S12 of FIG. 4, it is judged whether or not there exists an illumination equipment 30 planned to be set as the in-advance setting equipment and for which the DMX number is not set, for all ports of each signal conversion device 20.

When the judgment result of step S22 is negative (No), a completion screen indicating that the DMX numbers are set for all illumination equipments 30 is displayed on the display 34 (step S26), and the process is completed.

On the other hand, when the judgment result of step s22 is positive (Yes), a "no-setting found icon" is displayed on the corresponding port corresponding to the illumination equipment 30 planned to be set and for which the DMX number is not set, on the display 34, as a third alert (step S23).

As shown at the lower part of FIG. 7, white color means removal of the equipment. A portion shown by γ in FIG. 10 indicates that the "no-setting found icon" is displayed on the corresponding port of the display 34, and that a sand-like portion of the γ portion indicates a white color. In this case, the "no-setting found icon" is an icon of the same shape as and a different color from the icon 36, but alternatively, the icon may be an icon having a different shape from the icon 36.

In this manner, the user can recognize that there is an illumination equipment 30 planned to be set and for which the DMX number is not set. When the user touches the "no-setting found icon", in step S24 of FIG. 6, a dialog of "do you wish to delete equipment?" is displayed on the screen of the display 34 as a user alert screen. When the user intends to delete the equipment, the user selects "yes" in this dialog, that is, positive (Yes) is selected in step S24. In this case, the process proceeds to step S25. In step S25, after the setting of the illumination equipment 30 is deleted from the corresponding port, the process returns to step S22. As described above, the control device 12 displays the "non-setting found icon" on the display 34 when there is an input of a completion command from the user and when no illumination equipment 30 is connected to the port on the side of the signal conversion device 20 to which an illumination equipment 30 is planned to be connected.

On the other hand, when the user selects "no" in the dialog, that is, when negative (No) is selected in step S24 of FIG. 6, the process returns to step S11 of FIG. 4, and the system is set in a state of waiting for the user to press the automatic setting input accepting unit 38 (FIG. 7) on the display 34. In this case, the system is set in a wait state of the automatic setting input. Then, after the worker hangs the illumination equipment 30 for which the DMX number is not set, on the corresponding port, when the automatic setting input accepting unit 38 is pressed again, the automatic setting mode is restarted, and the process is repeated.

According to the illumination system 10, the setting method of the illumination equipment 30, and the operation terminal 11, it becomes possible to quickly set the DMX number for the illumination equipment 30 during the hanging work of the illumination equipment 30 in the environment in which a large number of illumination equipments 30 can be placed. For example, because the DMX number for the illumination equipment 30 is set every time the hanging operation of the illumination equipment 30 is executed, and the error is detected while the hanging operation is executed, it is possible to quickly finish the hanging work.

In the above description, a case is described in which the display 34 has the function as the input accepting unit which accepts input by an operation of the touch panel, but alternatively, the input accepting unit may be provided at a device separate from the display 34 such as an operation unit of a keyboard, a button, or the like.

In addition, in the above description, the type of the illumination equipment 30 is displayed on the display 34 with an icon, but alternatively, the type may be displayed using a pattern, a text string, or the like in place of the icon. Further, the portion showing the alert display on the display 34 may be displayed by a pattern, a text string, or the like, in place of or in addition to the icon.

Moreover, in FIG. 4 described above, it is judged in step S13 whether or not there is an input of a completion command from the user. Alternatively, it may be possible to judge in the step S13 whether or not there is at least one of an input of the completion command or elapse of a predetermined time after input by pressing of the automatic setting input accepting unit 38 (FIG. 7). For example, when it is judged that the predetermined time has elapsed, the process proceeds to step S22 of FIG. 6.

In addition, in the above description, a case is described in which there are two types as the types of the illumination equipments 30, but alternatively, the types may be a plurality of types of three or greater.

Further, as the color of the display of the screen of FIG, 7, various colors including the color of the case of the alert may be employed. In the above description, a case is described in which the alert is given by the display on the display 34, but the alert is not limited thereto, and, for example, the alert may be provided as a sound by a sound generator, a buzzer, or the like.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fail within the true scope of the present teachings.

The invention claimed is:

1. An illumination system in which a plurality of illumination equipments are connected to a control device via a relay, the illumination system comprising:

an alert unit connected to the control device, wherein the control device stores in advance information on the relay and a planned connection equipment type which is a type of the illumination equipment planned to be connected to the relay, and during work to connect the illumination equipment to the relay, the control device: searches whether or not the illumination equipment is connected, through the relay; when the control device detects that the illumination equipment is connected based on a transmission signal from the illumination equipment, sends an inquiry on a type of the illumination equipment to the illumination equipment and acquires information on the type of the illumination equipment; when the information on the type of the illumination equipment is the same as the planned connection equipment type stored in advance, sets an identification number for the illumination equipment connected to the control device; and, when the information on the type of the illumination equipment differs from the planned connection equipment type stored in advance, causes the alert unit to generate a first alert.

2. The illumination system according to claim 1, wherein when the control device detects that the illumination equipment is connected based on the transmission signal from the illumination equipment, and the illumination equipment is not planned to be connected to a port on a side of the relay for which the connection of the illumination equipment is detected, the control device causes the alert unit to generate a second alert.

3. The illumination system according to claim 1, wherein when a completion command is input from a user or a predetermined time which is set in advance has elapsed, and the illumination equipment is not connected to a port on a side of the relay to which the illumination equipment is planned to be connected, the control device causes the alert unit to generate a third alert.

4. The illumination system according to claim 1, wherein the alert unit is a display, and the first alert is provided as a display of an exchange equipment found icon on the display.

5. The illumination system according to claim 2, wherein the alert unit is a display, and the second alert is provided as a display of an additional equipment found icon on the display.

6. The illumination system according to claim 3, wherein the alert unit is a display, and the third alert is provided as a display of a no-setting found icon on the display.

7. An operation terminal used for forming the illumination system of claim 1, comprising:

the control device and the alert unit.

8. A method of setting illumination equipment in an illumination system in which a plurality of illumination equipments are connected to a control device via a relay, wherein the control device stores in advance information on the relay and a planned connection equipment type which is a type of the illumination equipment planned to be connected to the relay, and the method comprises: during work to connect the illumination equipment to the relay, searching, with the control device, whether or not the illumination equipment is connected, through the relay; when the control device detects that the illumination equipment is connected based on a transmission signal from the illumination equipment, sending, with the control device, an inquiry on a type of the illumination equipment to the illumination equipment and acquiring information on the type of the illumination equipment; when the information on the type of the illumination equipment is the same as the planned connection equipment type stored in advance, setting, with the control device, an identification number for the illumination equipment connected to the control device; and, when the information on the type of the illumination equipment differs from the planned connection equipment type stored in advance, causing, with the control device, an alert unit connected to the control device to generate a first alert.

9. The method of setting the illumination equipment in the illumination system according to claim 8, further comprising:

when the control device detects that the illumination equipment is connected based on the transmission signal from the illumination equipment, and the illumination equipment is not planned to be connected to a port on a side of the relay for which the connection of the illumination equipment is detected, causing, with the control device, the alert unit to generate a second alert.

10. The method of setting the illumination equipment in the illumination system according to claim 8, further comprising:

when a completion command is input from a user or a predetermined time which is set in advance has elapsed, and the illumination equipment is not connected to a port on a side of the relay to which the illumination equipment is planned to be connected, causing, with the control device, the alert unit to generate a third alert.

11. The method of setting the illumination equipment in the illumination system according claim 8, wherein the alert unit is a display, and the first alert is provided as a display of an exchange equipment found icon on the display.

12. The method of setting the illumination equipment in the illumination system according to claim 9, wherein the alert unit is a display, and the second alert is provided as a display of an additional equipment found icon on the display.

13. The method of setting the illumination equipment in the illumination system according to claim 10, wherein the alert unit is a display, and the third alert is provided as a display of a no-setting found icon on the display.

* * * * *